US005664441A

United States Patent [19]

Clerici

[11] Patent Number: 5,664,441

[45] Date of Patent: *Sep. 9, 1997

[54] FABRIC TAPE WITH LOOPS FOR USE AS PART OF HOOK-AND-LOOP FASTENER ASSEMBLY

[75] Inventor: Piero Rusconi Clerici, Milan, Italy

[73] Assignee: Aplix, Inc., Charlotte, N.C.

[ * ] Notice: The term of this patent shall not extend beyond the expiration date of Pat. No. 5,520,021.

[21] Appl. No.: 648,427

[22] Filed: May 15, 1996

Related U.S. Application Data

[63] Continuation-in-part of Ser. No. 427,797, Apr. 26, 1995, Pat. No. 5,520,021, which is a continuation of Ser. No. 229,165, Apr. 18, 1994, abandoned.

[51] Int. Cl.[6] ..... D04B 23/08; D04B 23/10; D03D 3/00

[52] U.S. Cl. ..... 66/193; 66/191; 66/195

[58] Field of Search ..... 66/191, 192, 193, 66/195

[56] References Cited

U.S. PATENT DOCUMENTS

| | | | |
|---|---|---|---|
| 2,696,728 | 12/1954 | Frith, Jr. . | |
| 3,448,595 | 6/1969 | Baltzer et al. | 66/193 |
| 3,531,953 | 10/1970 | Hutto, Jr. et al. . | |
| 3,603,117 | 9/1971 | Syoboda et al. | 66/193 |
| 3,845,641 | 11/1974 | Waller . | |
| 3,943,981 | 3/1976 | De Brabander | 139/391 |
| 4,654,264 | 3/1987 | Provost et al. | 428/88 |
| 4,677,011 | 6/1987 | Matsuda | 428/88 |
| 5,125,246 | 6/1992 | Shytles . | |

FOREIGN PATENT DOCUMENTS

| | | |
|---|---|---|
| 0223024 | 5/1987 | European Pat. Off. . |
| A-0 284 020 | 9/1988 | European Pat. Off. . |
| A-0 517 275 A2 | 12/1992 | European Pat. Off. . |
| A-0 589 395 A1 | 3/1994 | European Pat. Off. . |
| A-2 632 830 | 12/1989 | France . |
| WO92/21805 | 12/1992 | WIPO . |

*Primary Examiner*—John J. Calvert
*Attorney, Agent, or Firm*—Adams Law Firm, P.A.

[57] ABSTRACT

A fabric tape having loops for complementary attachment to a hook-carrying member of a hook-and-loop fastener assembly. The fabric tape includes a fabric backing having a front face and a rear face; and a multitude of elongated yarn loops formed on the front face of the backing, at least some of the loops defining a clockwise-extending axis with reference to the front face of the backing and at least some of the loops defining a counter-clockwise-extending axis with reference to the front face of the backing. The loops are positioned in uniform ranks and files on the front face of the backing.

6 Claims, 7 Drawing Sheets

FABRIC TAPE WITH LOOPS FOR USE AS PART OF HOOK-AND-LOOP FASTENER ASSEMBLY

This application is a continuation-in-part of U.S. patent application Ser. No. 08/427,797, filed on Apr. 26, 1995, now U.S. Pat. No. 5,520,021, issued on May 28, 1996, which is a continuation of U.S. patent application Ser. No. 08/229,165, filed on Apr. 18, 1994, now abandoned.

TECHNICAL FIELD AND BACKGROUND OF THE INVENTION

Such assemblies, also referred to as "touch fasteners", are used in many different applications to releasably hold two mating parts together.

This invention relates to a fabric tape which has a construction particularly useful as the loop-part of a hook-and-loop fastener assembly. One application, used herein for purposes of illustration, is as an assembly for holding seat cover upholstery on a molded foam seat cushion, such as an automobile seat.

Typically, strips of material having stiff, upright hooks, are molded into a foam seat cushion in a particular pattern. See FIG. 6. These strips of hook material collectively determine the appearance of the seat once manufacture is complete by providing attachment points for the overlying upholstery. The attachment points give the appearance of separate cushions, pleats, tucks and similar features when the upholstery is pulled over the molded cushion.

This is accomplished by sewing together adjacent edges of the upholstery panels with an overlying length of looped fabric tape, thereby binding the seam. See FIGS. 2 and 3. The seams of the upholstery match the locations of the strips of hook material molded into the seat cushions. The loops project outwardly from the surface of the fabric tape. When the upholstery is pulled over the molded seat cushion, and the seams pressed inwardly against the strips of hook material, those portions of the seat upholstery are held in an inwardly-contoured configuration, giving the seat a sculptured, contoured look. See FIG. 5.

Prior art fabric loop tapes offer disadvantages, including high cost, corner buckling, thin, tear-prone loops and flat loops which are difficult for the hooks to grip, all of which reduce the effectiveness and efficiency with which the seats are manufactured. The invention described in this application is directed towards the solution of several of these problems, as described below.

SUMMARY OF THE INVENTION

Therefore, it is an object of the invention to provide a fabric loop tape for use in a hook-and-loop fastener assembly.

It is another object of the invention to provide a fabric loop tape which is inexpensive to manufacture.

It is another object of the invention to provide a fabric loop tape which is easy to sew.

It is another object of the invention to provide a fabric loop tape which has upright loops which are easy for the hooks of the complementary hook strips to grip and securely hold.

It is another object of the invention to provide a fabric loop tape with a fabric backing which is stable.

It is another object of the invention to provide a fabric loop tape which has some loops which extend in a clockwise direction with reference to the fabric base and some loops which extend in a counterclockwise direction, thus insuring that at least some loops are always angled to effectively and efficiently receive the hooks of the hook strip.

It is another object of the invention to provide a fabric loop tape which has multifilament loops which are strong and tear-resistant.

These and other objects of the present invention are achieved in the preferred embodiments disclosed below by providing a fabric tape having loops for complementary attachment to a hook-carrying member of a hook-and-loop fastener assembly. The fabric tape includes a narrow, crochet-type flat knitted backing having a front face and a rear face; and a multitude of elongated yarn loops formed on the front face of the backing, at least some of the loops defining a clockwise-extending axis with reference to the front face of the backing and at least some of the loops defining a counterclockwise-extending axis with reference to the front face of the backing.

According to one preferred embodiment of the invention, the loops are positioned in uniform ranks and files on the front face of the backing.

According to another preferred embodiment of the invention, the fabric is a crochet-type flat-knitted fabric having lengthwise warp yarns and width wise weft yarns.

According to yet another preferred embodiment of the invention, each loop is comprised of a length of a yarn extending along the length of the fabric and forming a multitude of adjacent loops.

According to yet another preferred embodiment of the invention, each loop is attached to adjacent weft yarns and adjacent warp yarns.

According to one preferred embodiment of the invention, the front face of the fabric tape contains at least 20 loops per square centimeter.

Preferably, the front face of the fabric tape contains no more than 50 loops per square centimeter.

According to one preferred embodiment of the invention, the fabric contains at least 12 150-denier weft yarns per centimeter, 6 150-denier warp yarns per centimeter and at least 20 and no more than 50 200-denier loop yarns per square centimeter.

According to another preferred embodiment of the invention, the fabric contains 13 300-denier weft yarns per centimeter, 6 300-denier warp yarns per centimeter and at least 20 and no more than 50 300-denier loop yarns per square centimeter.

According to yet another preferred embodiment of the invention, the fabric contains no more than 14 600-denier weft yarns per centimeter, no more than 6 450-denier warp yarns per centimeter and at least 20 and no more than 50 400-denier loop yarns per square centimeter.

According to yet another preferred embodiment of the invention, the loop yarns are multifilament yarns.

According to yet another preferred embodiment of the invention, the loops extend along the length of the tape in alternating clockwise and counterclockwise loops.

According to one preferred embodiment of the invention, a first series of loops extends across the width of the fabric in the weft direction along a first group of adjacent courses and are clockwise in orientation; and a second series of loops extend across the width of the fabric in the weft direction along a second group of adjacent courses alternating with the first group of courses, and are counterclockwise in orientation.

According to yet another preferred embodiment of the invention, all of the loops in a group of adjacent courses are alternately clockwise and counterclockwise in direction.

According to yet another preferred embodiment of the invention, the fabric contains 36 loops per square centimeter evenly divided between clockwise and counterclockwise loops.

It is also with the scope of the invention that each of the two feet of a loop, by which the loop is attached to the backing or base, is located at a point of intersection of two warp and weft yarns, with the two warp yarns and/or said two weft yarns being adjacent or non-adjacent, respectively.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
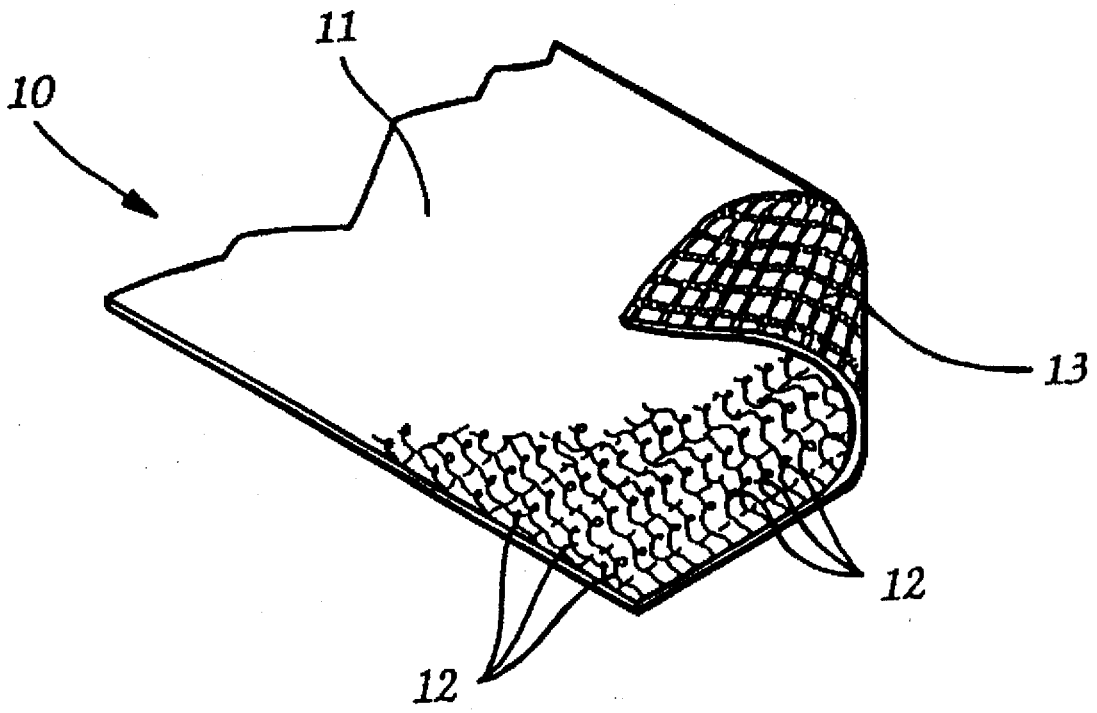
FIG. 1 is a schematic perspective view of a fabric tape with loops according to an embodiment of the invention.

Referring now specifically to the drawings, a fabric loop tape according to the present invention is illustrated in FIG. 1 and shown generally at reference numeral 10. In general, the fabric loop tape 10 has a front face 11 with ranks and files of multifilament loops 12, and a rear face 13. In accordance with the embodiment of the invention disclosed in this application, the fabric loop tape 10 is formed on a linear-type crochet knitting machine as a narrow tape. Thus, no slitting or other sizing other than cutting to length is required for use of the fabric loop tape 10.

Figure 2:
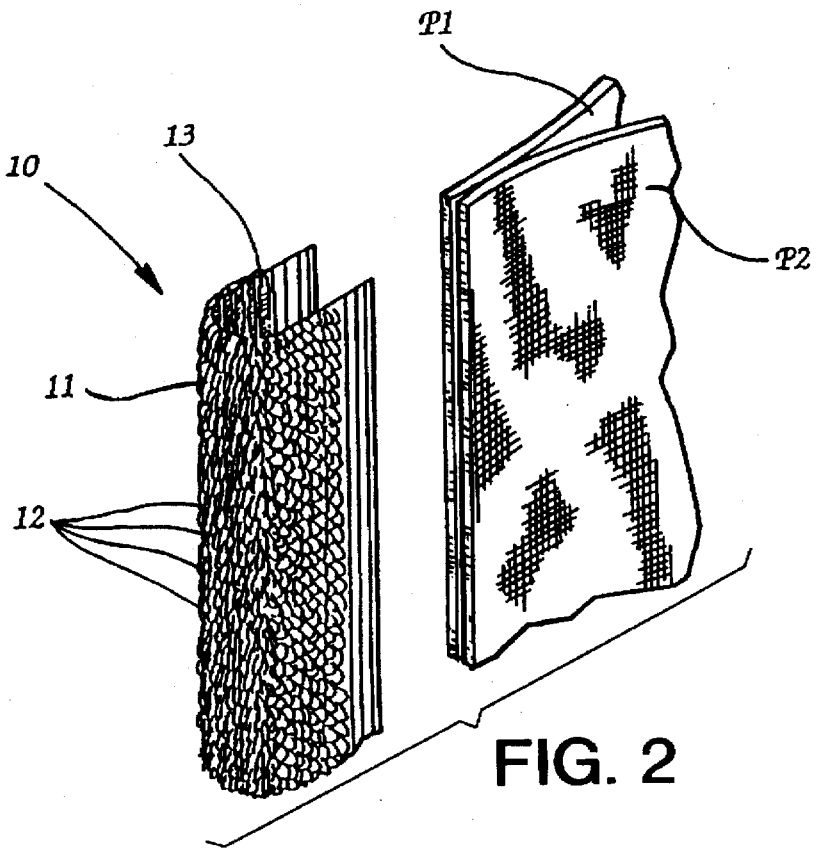
FIG. 2 is a fragmentary perspective view of two adjacent fabric pieces being assembled with its seam being bound by a length of the fabric loop tape shown in FIG. 1.
Figure 3:
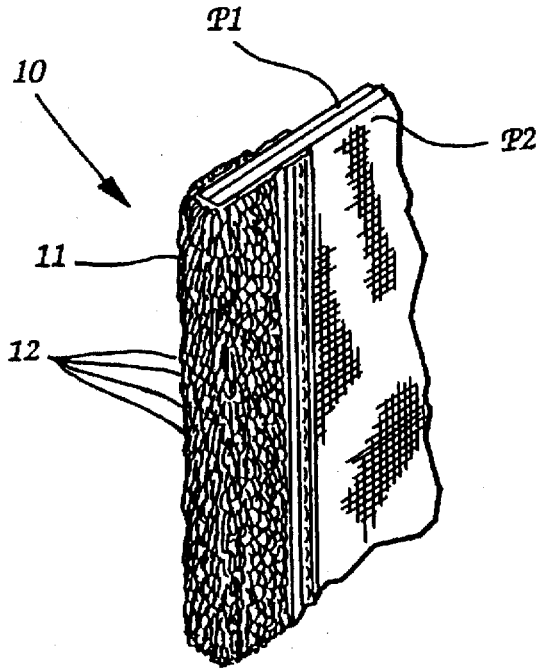
FIG. 3 is a fragmentary perspective view of the assembled structure of FIG. 2.

As is shown in FIG. 2, the fabric loop tape 10 is used by forming it into a U-shape and binding it onto a raised seam formed by sewing together two adjacent fabric pieces, such as seat upholstery pieces P1 and P2. The completed structure is shown in FIG. 3. By way of example, an entire seat back upholstery cover will be assembled in the manner described above with reference to FIGS. 2 and 3.

Figure 4:
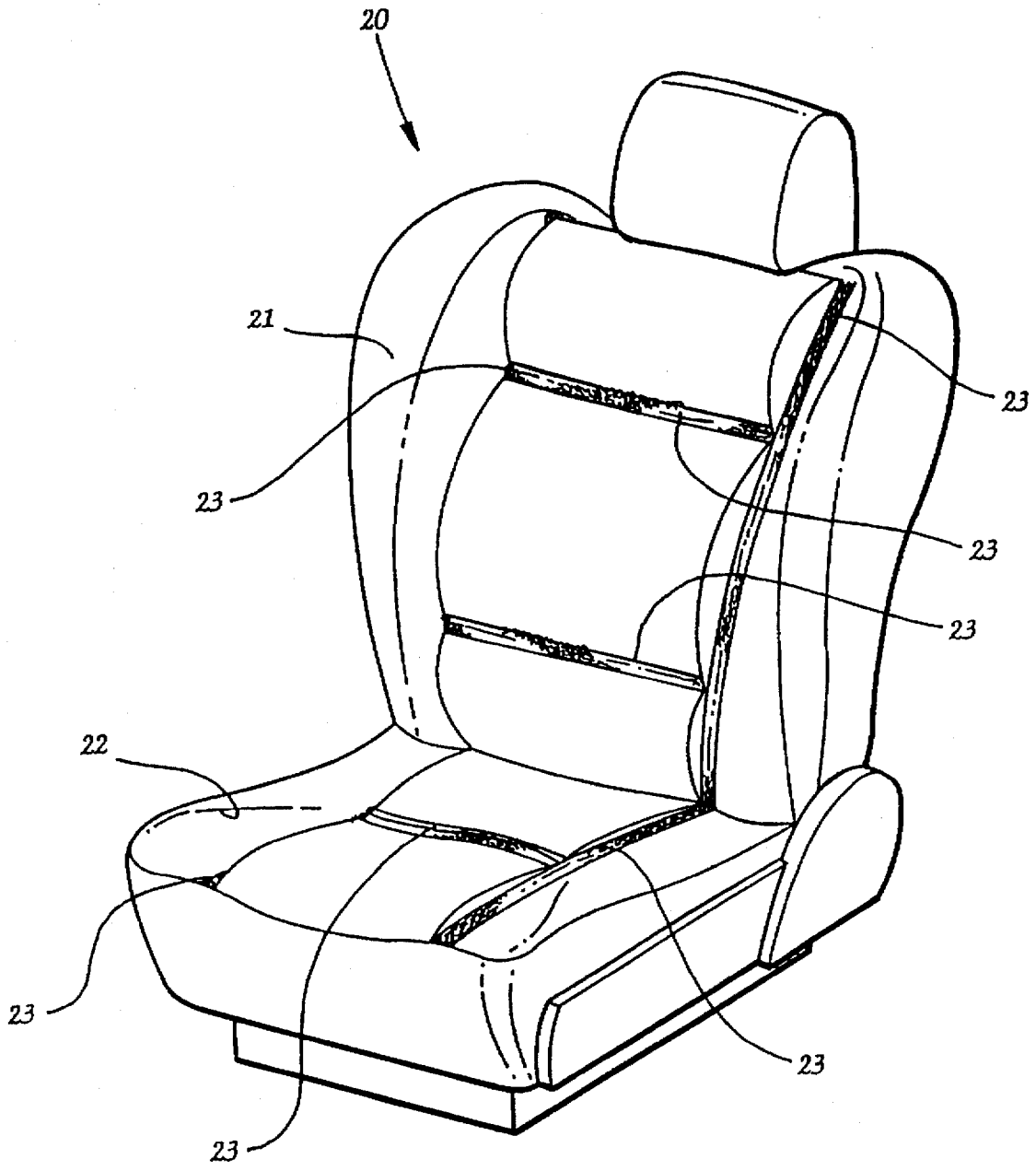
FIG. 4 is a perspective view of an automobile seat with molded-in hook strips for use in attaching upholstery.

FIG. 4 illustrates a seat 20 having a molded foam seat back cushion 21 and a molded foam seat bottom cushion 22 constructed with molded-in strips of hooks 23 which correspond to the recesses and contours of the seat desired in the completed seat.

Figure 5:
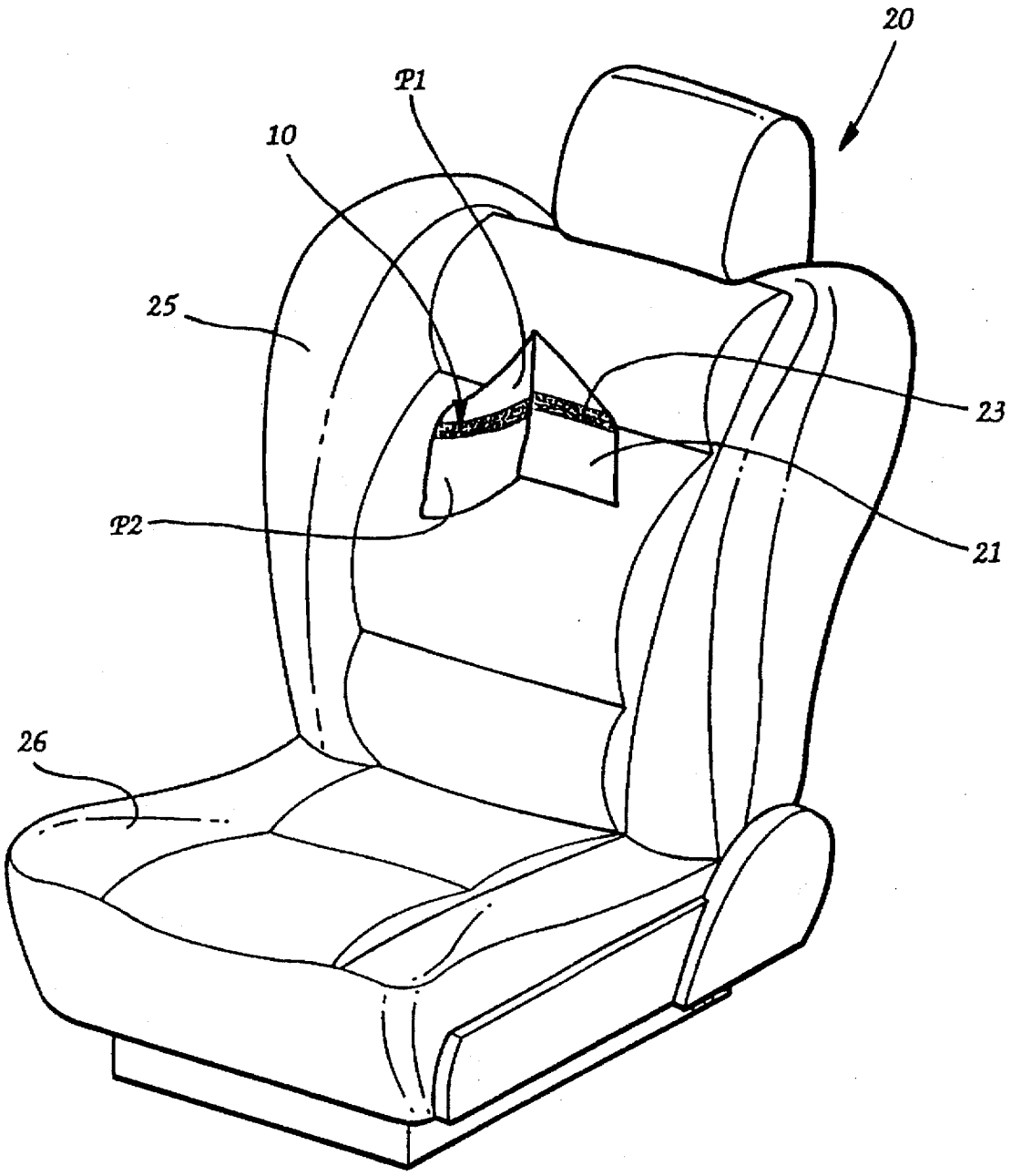
FIG. 5 is a perspective view of an automobile seat With attached upholstery, with a segment peeled away to show the attachment between the fabric loop tape and the hook strips.

As is shown in FIG. 5, an upholstery seat back cover 25 and an upholstery seat bottom cover 26 are pulled over the seat back and seat bottom cushions 21 and 22, respectively. By pressing the seams covered with the fabric tape 10 into the strips of hooks 23, a contoured, upholstered seat such as shown in FIG. 5 is fabricated. The mating loops of the fabric tapes 10 and the hooks of the strips 23 secure the upholstery to the underlying seats cushions 21 and 22 and also form the contouring as well.

The basic upholstered seat construction techniques described above are conventional. However, prior art fabric tapes result in less than optimum adherence between the upholstery and the foam cushion.

Figure 6:
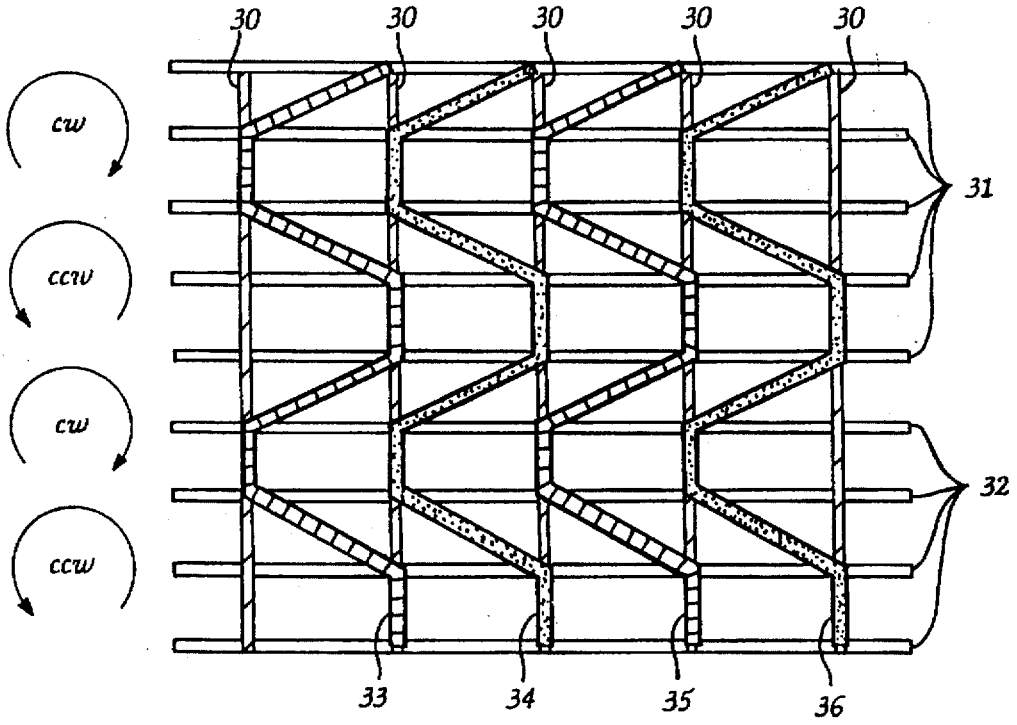
FIGS. 6, 7 and 8 are schematic views of the fabric construction of the fabric loop tape according to an embodiment of the invention.
Figure 7:
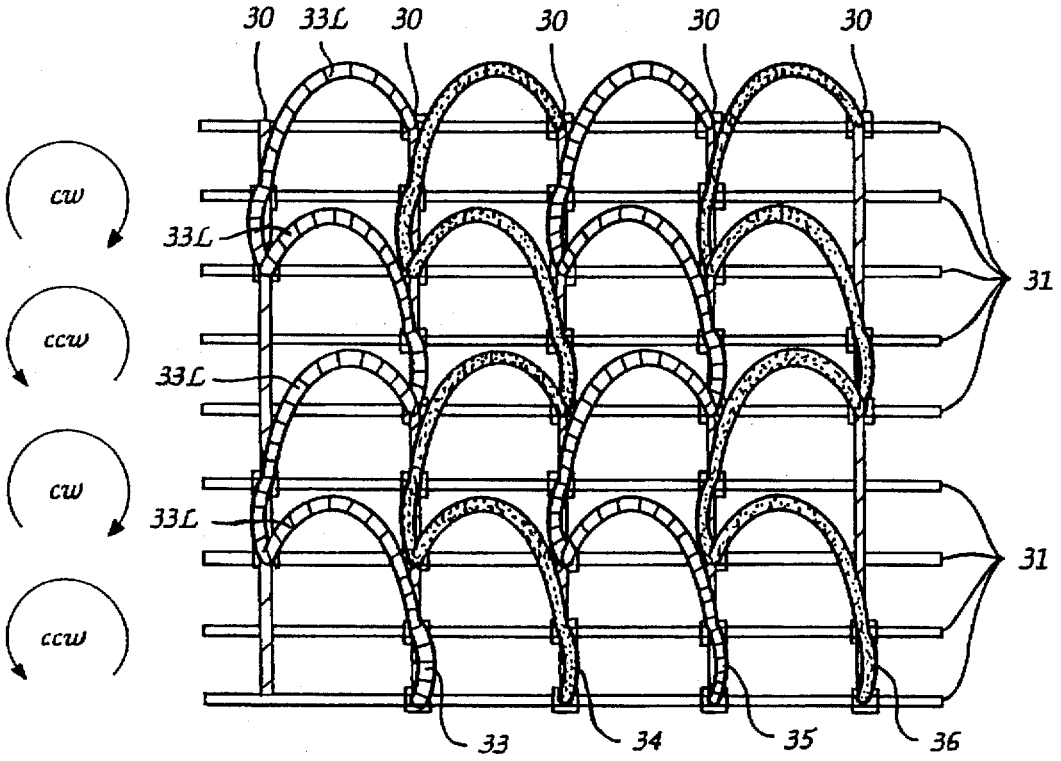
Figure 8:
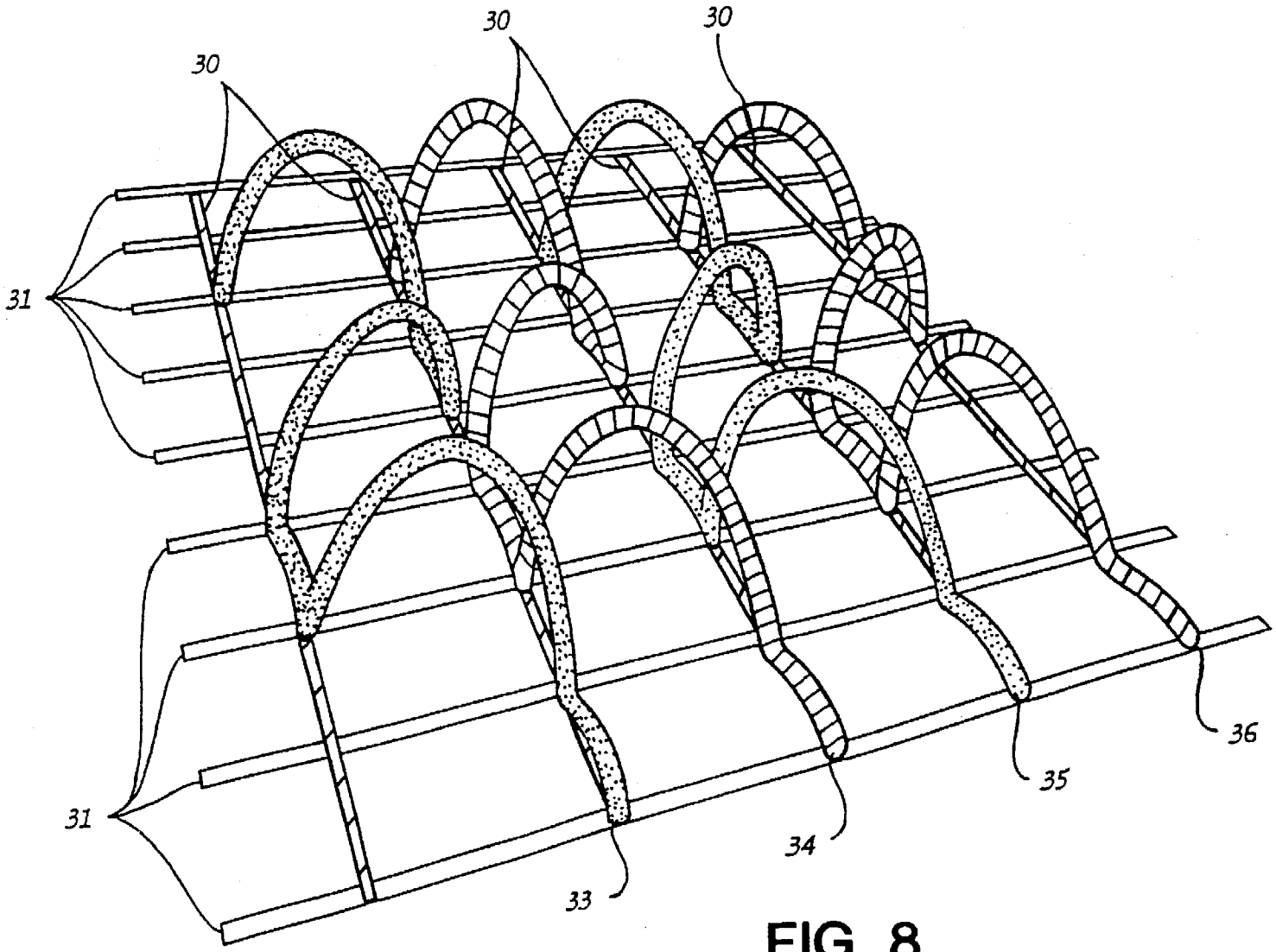

The fabric tape 10 shown in general in FIG. 1 is illustrated schematically and in further detail in FIGS. 6, 7 and 8. A significant feature of the invention is the formation of loops which are alternately clockwise and counterclockwise in orientation. As is shown in FIGS. 6 and 7, the flat-knit crochet fabric is comprised of warp yarns 30 which extend along the length of the fabric tape 10. Laterally-extending weft yarns 31 intersect with the warp yarns 30 to form the crochet-knitted structure of the fabric tape 10. The loop yarns 33, 34, 35 and 36 are knitted with the warp yarns 30 in order to give better resistance to tearing when the loops are pulled away from the warp yarns 30 by the mated hooks.

As is shown in FIG. 6, the loop yarns 33, 34, 35 and 36 move alternately between adjacent warp yarns 30 according to the pattern wherein, for example, loop yarn 33 links to consecutive weft yarns 31 along the same warp yarn 30, then forms a loop 33L as it shifts counterclockwise to the adjacent warp yarn 30. This alternating pattern repeats, and as is shown in FIGS. 6 and 7, alternating counterclockwise and clockwise loops 33L are formed along a series of adjacent weft yarns extending along the length of the fabric tape 10. Viewed laterally, a row of counterclockwise loops 33L extend from one side of the fabric tape 10 to the other, alternating with laterally-extending clockwise loops 33L.

An enlarged perspective view intended to show more clearly the alternating clockwise and counterclockwise orientation of the loops 33L is shown in FIG. 8. Since all of the hooks on the hook strips 23 are angled in the same direction, the alternating direction of the loops 33L insure that at least some loops are always angled to effectively and efficiently receive the hooks of the hook strips 23.

The table below provides parameters within which a preferred embodiment of a fabric tape 10 can be manufactured to perform the functions as described in this application, expressed in denier. The warp and weft yarns 30 and 31 are texturized polyester multifilament, while the loop yarns 33–36 are formed of multifilament nylon flat yarn.

| | WARP | WEFT | LOOP | WEFT/CM | LOOPS/CM/SQ. |
|---|---|---|---|---|---|
| MIN. | 150 | 150 | 200 | 12 | 20 |
| AVER. | 300 | 300 | 300 | 13 | 36 |
| MAX. | 450 | 600 | 400 | 14 | 40 |

The loops 33L are preferably 20 denier per filament, with the appropriate number of filaments to provide the specified multifilament loop yarns 33L. This provides loops which are strong enough to stand upright instead of lying flat. In addition, the loops 33L are strong enough that they will not break loose from the hooks if stress is placed on the joined assembly.

Figure 9:
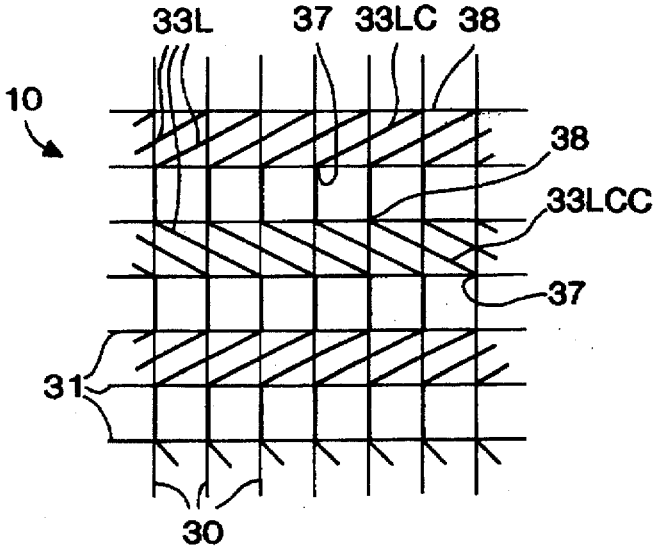
FIGS. 9, 10 and 11 are schematic views of the fabric construction of the fabric loop tape according to a further embodiment of the invention.
Figure 10:
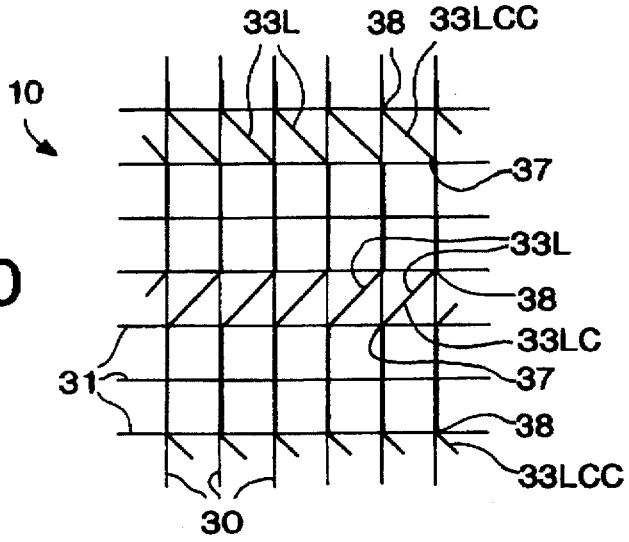
Figure 11:
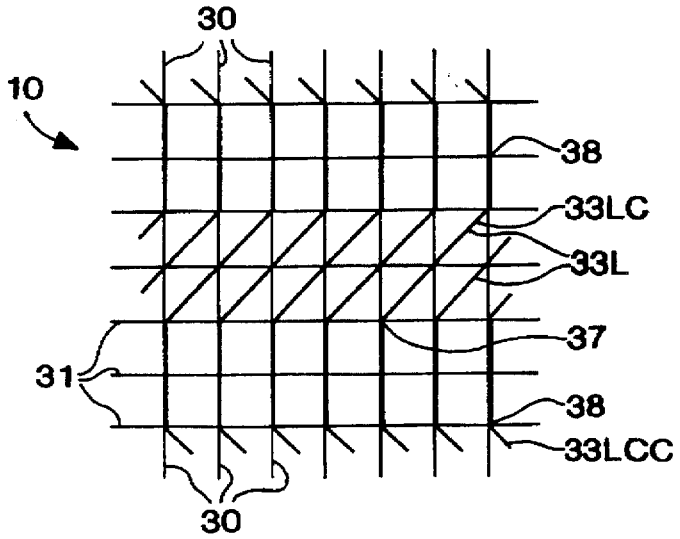

FIGS. 9 through 11 illustrate other embodiments which fall within the scope of the invention. In these embodiments the loops 33 do not extend between adjacent or successive warp yarns 30 and weft yarns 31. These embodiments are usable in circumstances where the density of the warp or weft yarns may otherwise be too high, causing bunching of the loops where they are attached to the fabric structure.

FIG. 9 illustrates an embodiment wherein each loop yarn 33 is attached to adjacent weft yarns 31 and to every other warp yarn 30. In FIG. 10 the loops 33 are attached successively to every other weft yarn 31 and to adjacent warp yarns 30. In FIG. 11 the loop yarns 33 are attached to every other weft yarn 31 and to every other warp yarn 30.

Other embodiments can be derived from FIGS. 9–11 by providing a structure wherein in the basic zig-zag pattern the loop yarns 33 jump at least one weft yarn 31 and/or warp yarn 30.

A fabric tape with loops is described above. Various details of the invention may be changed without departing from its scope. Furthermore, the foregoing description of the preferred embodiment of the invention and the best mode for practicing the invention are provided for the purpose of illustration only and not for the purpose of limitation--the invention being defined by the claims.

I claim:

1. A nonelastic fabric tape having loops for complementary attachment to hooks carried on a member of a hook-and-loop fastener assembly, said fabric tape comprising:

(a) a narrow flat knitted backing having a front face and a rear face and formed of knitted warp and weft yarns forming a nonelastic backing; and (b) a plurality of loop yarns attached by knitting stitches to said warp yarns at spaced-apart points to form upstanding loops on the front face of said backing, at least some of said loop yarns being canted in a first direction with reference to the front face of the backing and others of said loop yarns being canted in a second direction with reference to the front face of the backing opposite said first direction, said loop yarns being attached to said warp yarns according to the pattern wherein:

(1) each of said loop yarns being attached to a first warp yarn at an intersection of said first warp yarn with a first weft yarn;

(2) said each of said loop yarns being attached to said first warp yarn at an intersection between said first warp yarn and a second weft yarn adjacent said first weft yarn without forming an upstanding loop between said intersections;

(3) said each of said loop yarns being attached to a second warp yarn adjacent said first warp yarn at an intersection between said second warp yarn and a third weft yarn adjacent said second weft yarn, said loop yarn forming the upstanding loop between said second warp yarn and a third weft yarn adjacent said second weft yarn; and (4) said first and second warp yarns are adjacent to each other.

2. A fabric tape according to claim 1, wherein said first and second warp yarns are separated by at least one other warp yarn.

3. A fabric tape according to claim 1, wherein said first and second weft yarns are adjacent to each other.

4. A fabric tape according to claim 1, wherein said first and second weft yarns are separated by at least one other weft yarn.

5. A fabric tape according to claim 2, wherein said loops extend along the length of the tape in an alternating canted orientation.

6. A fabric tape according to claim 1, wherein approximately one-half of the loops in a group of adjacent courses are alternately canted in one direction and in another direction.

* * * * *